US010900287B2

(12) United States Patent
Wheeler et al.

(10) Patent No.: US 10,900,287 B2
(45) Date of Patent: Jan. 26, 2021

(54) ARTICULATED JOINT FOR DOWNHOLE STEERING ASSEMBLY

(71) Applicant: Halliburton Energy Services, Inc., Houston, TX (US)

(72) Inventors: Fraser A. Wheeler, Edmonton (CA); Geoffrey A. Samuel, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 16/342,374

(22) PCT Filed: Nov. 16, 2016

(86) PCT No.: PCT/US2016/062162
§ 371 (c)(1),
(2) Date: Apr. 16, 2019

(87) PCT Pub. No.: WO2018/093359
PCT Pub. Date: May 24, 2018

(65) Prior Publication Data
US 2019/0264509 A1 Aug. 29, 2019

(51) Int. Cl.

| | |
|---|---|
| ***E21B 7/08*** | (2006.01) |
| ***F16D 3/20*** | (2006.01) |
| ***E21B 7/06*** | (2006.01) |
| ***E21B 17/04*** | (2006.01) |

(52) U.S. Cl.
CPC ..... *E21B 7/067* (2013.01); *E21B 7/06* (2013.01); *E21B 17/04* (2013.01)

(58) Field of Classification Search
CPC ..... E21B 7/04; E21B 7/06; F16D 3/16; F16D 3/202; F16D 3/2057
See application file for complete search history.

(56) References Cited

U.S. PATENT DOCUMENTS

| | | | | | |
|---|---|---|---|---|---|
| RE16,829 | E | * | 12/1927 | Franke | F16D 3/2057 464/82 |
| 2,266,383 | A | * | 12/1941 | Quintrell | E21B 7/06 464/19 |
| 2,402,238 | A | * | 6/1946 | Carpenter | E21B 7/06 175/256 |
| 3,074,254 | A | * | 1/1963 | Jones, Sr. | F16D 3/58 464/83 |

(Continued)

FOREIGN PATENT DOCUMENTS

| | | |
|---|---|---|
| WO | 2014029985 | 2/2014 |

OTHER PUBLICATIONS

ISRWO International Search Report and Written Opinion for PCT/US2016/062162 dated Aug. 16, 2017.

*Primary Examiner* — Kenneth L Thompson
(74) *Attorney, Agent, or Firm* — Benjamin Ford; C. Tumey Law Group PLLC

(57) ABSTRACT

A steering assembly includes an outer housing and a drive shaft extended longitudinally within the outer housing and defining a plurality of pockets. A plurality of torque transfer features transfer torsional loads from the outer housing to the drive shaft, each torque transfer feature including a shank received within a corresponding one of the plurality of pockets. One or more elastic mounts positioned within each pocket interpose the shank and an inner wall of each pocket.

20 Claims, 7 Drawing Sheets

(56) References Cited

U.S. PATENT DOCUMENTS

| | | | | |
|---|---|---|---|---|
| 3,667,556 | A * | 6/1972 | Henderson | E21B 7/068 175/73 |
| 4,114,404 | A * | 9/1978 | Phelps | F16D 3/221 464/152 |
| 4,551,115 | A | 11/1985 | Ferguson | |
| 4,811,798 | A * | 3/1989 | Falgout, Sr. | E21B 7/068 175/256 |
| 6,460,633 | B1 * | 10/2002 | Driver | E21B 7/064 175/256 |
| 6,837,315 | B2 | 1/2005 | Pisoni et al. | |
| 6,949,025 | B1 | 9/2005 | Kraus et al. | |
| 7,186,182 | B2 | 3/2007 | Wenzel et al. | |
| 7,624,819 | B1 | 12/2009 | LeBlanc et al. | |
| 8,033,917 | B2 | 10/2011 | Prill et al. | |
| 8,342,970 | B2 | 1/2013 | Altimas et al. | |
| 8,590,636 | B2 | 11/2013 | Menger | |
| 8,900,062 | B2 | 12/2014 | Nicol-Seto | |
| 2002/0073528 | A1 | 6/2002 | Tibbitts | |
| 2012/0312600 | A1 | 12/2012 | Abbasi | |
| 2014/0112640 | A1 | 4/2014 | Saitou et al. | |
| 2015/0014059 | A1 | 1/2015 | Perry | |
| 2016/0084017 | A1 | 3/2016 | Finke et al. | |
| 2018/0209483 | A1 * | 7/2018 | Yu | B25B 13/06 |

* cited by examiner

ARTICULATED JOINT FOR DOWNHOLE STEERING ASSEMBLY

BACKGROUND

As subterranean hydrocarbon reservoirs become more difficult to reach, wellbore drilling operations have become more complex in both vertical and horizontal directions, and the need to precisely locate a downhole drilling assembly within desired subterranean formations increases. This requires accurately steering the drilling assembly either to avoid particular formations or to intersect formations of interest.

Drilling assemblies are commonly guided using a rotary steerable tool, which may or may not be powered by a downhole drilling motor (alternately referred to as a "mud motor"). A typical downhole drilling motor includes a motor suspended near the lower end of a string of drill pipe supported from a well surface location, such as a land-based or sea-based drilling rig. The motor includes a rotatable drive shaft that is directly or indirectly coupled to a rotary drill bit, such as a fixed cutter drill bit, a roller cone drill bit, a reamer, etc. The motor operates by circulating drilling fluid or "mud" through the drill pipe and into the motor, which generates torque that causes the drive shaft to rotate and thereby correspondingly rotate the drill bit.

Steering the drilling assembly with a rotary steerable tool includes changing the tool face direction of the drill bit coupled to the end of the drilling assembly. This can result in high axial, radial, and torsional loads transmitted across an articulated drive shaft joint (e.g., a constant velocity joint, a universal joint, etc.) that must accommodate the force loads.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to rotary steering assemblies used in the oil and gas industry and, more particularly, to a rotary steering assembly having an improved articulated joint used to couple opposing drive shafts across varying angles or articulation during operation.

Embodiments described herein provide improvements to articulated joints used in rotary steering assemblies. The rotary steering assembly includes an outer housing and a drive shaft extended longitudinally within the outer housing and defining a plurality of pockets. An articulated joint includes a plurality of torque transfer features used to transfer torsional loads from the outer housing to the drive shaft, and each torque transfer feature includes a shank received within a corresponding one of the plurality of pockets. One or more elastic mounts are positioned within each pocket to interpose the shank and an inner wall of each pocket and thereby provide an amount of flex or give to each torque transfer feature, which helps distribute torsional loads across all torque transfer features.

The rotary steering assemblies described herein are different from existing (conventional) designs by separating the geometric features from the elastic features required for compliance at articulated angles. Existing designs are focused on achieving the desired articulated joint motion and geometry and tend to accept the resulting compliance. Conventional articulated joints are designed with the assumption that torque is primarily transmitted through two points of contact, so previous design efforts have gone into maximizing the size of the two points of contact in order to maximize the torque carrying capability of the articulated joint. With elastic mounts positioned within the pockets, the embodiments described herein allow both goals (geometry and compliance) to be achieved independently from each other. Consequently, the embodiments described herein improve the compliance and load sharing ability of articulated joints with more than two points of contact, which results in the transmission of torsional loads via more than two torque transfer features to enhance load sharing. The ability to improve the load sharing within an articulated joint means that higher torque can be transmitted through existing articulated joint with the same space claim. For example, if 30% of a torsional load can be transferred to another torque transfer feature, then the torque carrying capacity of the articulated joint can be increased by 30%. It is contemplated herein to use the principles of the present disclosure in retrofitting existing articulated joints to significantly increase the torque carrying capacity.

Figure 1:
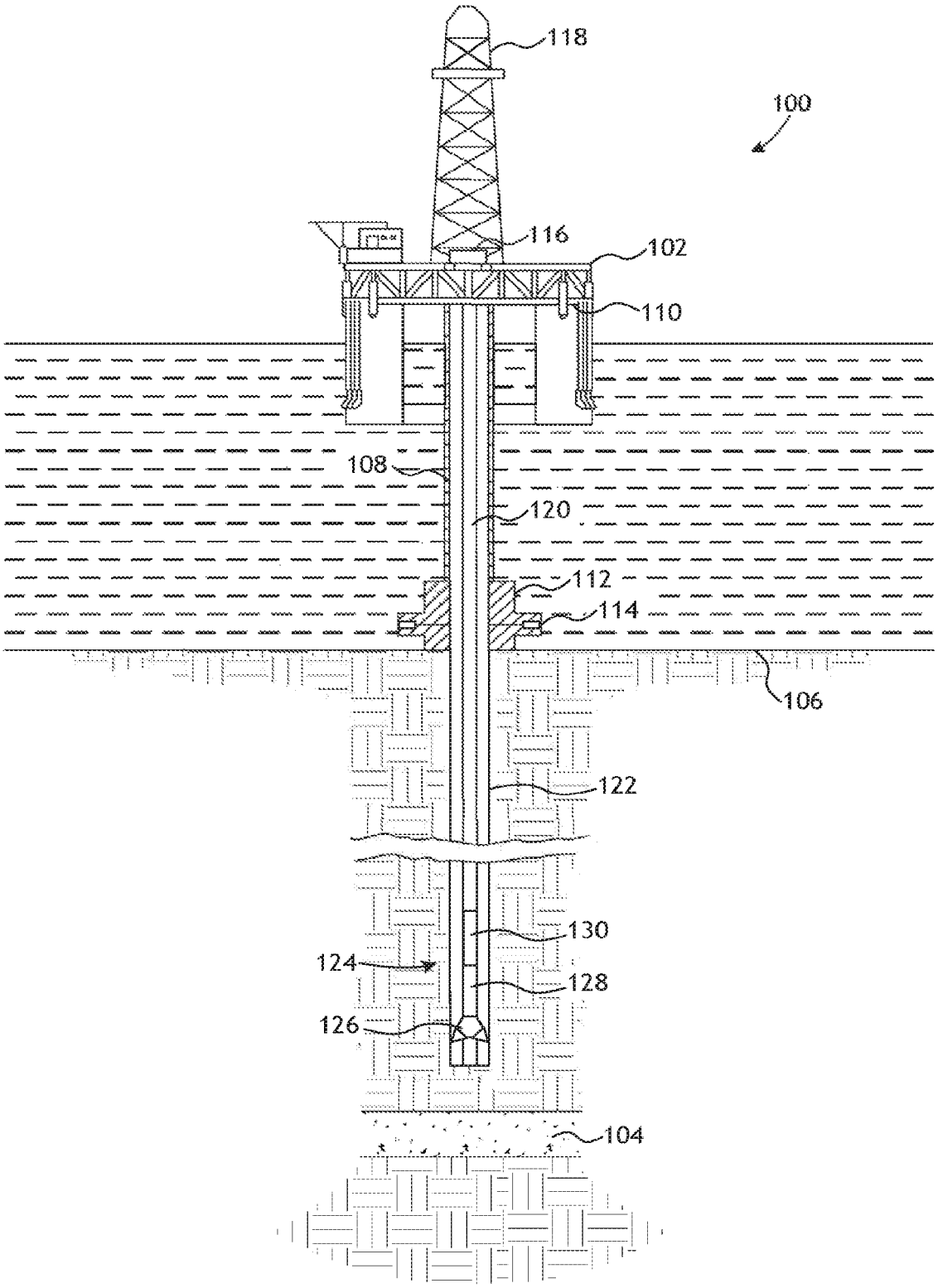
FIG. 1 depicts an example well system that may employ the principles of the present disclosure.

FIG. 1 depicts an example well system 100 that may employ the principles of the present disclosure, according to one or more embodiments. As illustrated, the well system 100 includes an offshore, semi-submersible oil and gas production platform 102 centered over a submerged oil and gas formation 104 located below a sea floor 106. Even though FIG. 1 depicts an offshore drilling operation, the principles of the present disclosure are equally well suited for use in onshore or "land-based" drilling operations or applications. In the illustrated embodiment, a subsea conduit or riser 108 extends from a deck 110 of the platform 102 to a wellhead installation 112 that may include one or more blowout preventers 114. The platform 102 has a hoisting apparatus 116 and a derrick 118 for raising and lowering tubular lengths of drill pipe, such as a drill string 120.

A wellbore 122 extends through the various earth strata toward the subterranean formation 104 and the drill string 120 is extended within the wellbore 122. At its distal end, the drill string 120 includes a bottom hole assembly (BHA) 124 that includes a drill bit 126 and a steering assembly 128 used to direct the drill bit 126. In some embodiments, the BHA 124 may further include a downhole drilling motor 130, alternately referred to as a "mud motor." During example operation, drilling fluid or "mud" is pumped through an interior fluid passageway of the drill string 120 to the downhole drilling motor 130, which converts the hydraulic energy of the circulating drilling fluid to mechanical energy in the form of a rotating rotor or drive shaft included in the downhole drilling motor 130. The drive shaft is operatively coupled to the drill bit 126 via the steering assembly 128, which causes rotation of the drill bit 126 and thereby allows the wellbore 122 to be extended. In other embodiments, however, the downhole drilling motor 130 may be omitted from the well system 100 and the drill string 120 may alternatively be rotated from the platform 102 to rotate the steering assembly 128 and the drill bit 126 and thereby drill the wellbore 122.

The steering assembly 128 may be operatively coupled (directly or indirectly) to the drill bit 126 to control drilling direction by controlling the angle and orientation of the drill bit 126 with respect to the BHA 124 and/or the formation 104. The steering assembly 128 controls the angle and orientation of the drill bit 126 by, for example, controlling the longitudinal axis of the drill bit 126 with respect to the longitudinal axis of the BHA 124 (i.e., a point-the-bit arrangement).

While directing the drill bit 126, the steering assembly 128 transmits axial and torsional loads across one or more articulated joints included in the steering assembly. At least one articulated joint within the steering assembly 128 functions to alter the longitudinal axis of the drill bit 126 with respect to the longitudinal axis of the BHA 124 while transmitting rotation and torque from the drill string 120 to the drill bit 126. In certain embodiments, the articulated joint may comprise a constant-velocity (CV) joint, which may be incorporated into the steering assembly 128 and other steering tools and downhole motors.

Even though FIG. 1 depicts a vertical wellbore 122 being drilled, the steering assembly 128 is equally well suited for use in horizontal, slanted, or deviated wellbores. Moreover, use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

As used herein, the term "couple" and any variation thereof refers to either an indirect or a direct connection between two structural elements. Thus, if a first device couples or is coupled to a second device, that connection may be through a direct connection or through an indirect mechanical connection via other devices and/or connections.

Figure 2:
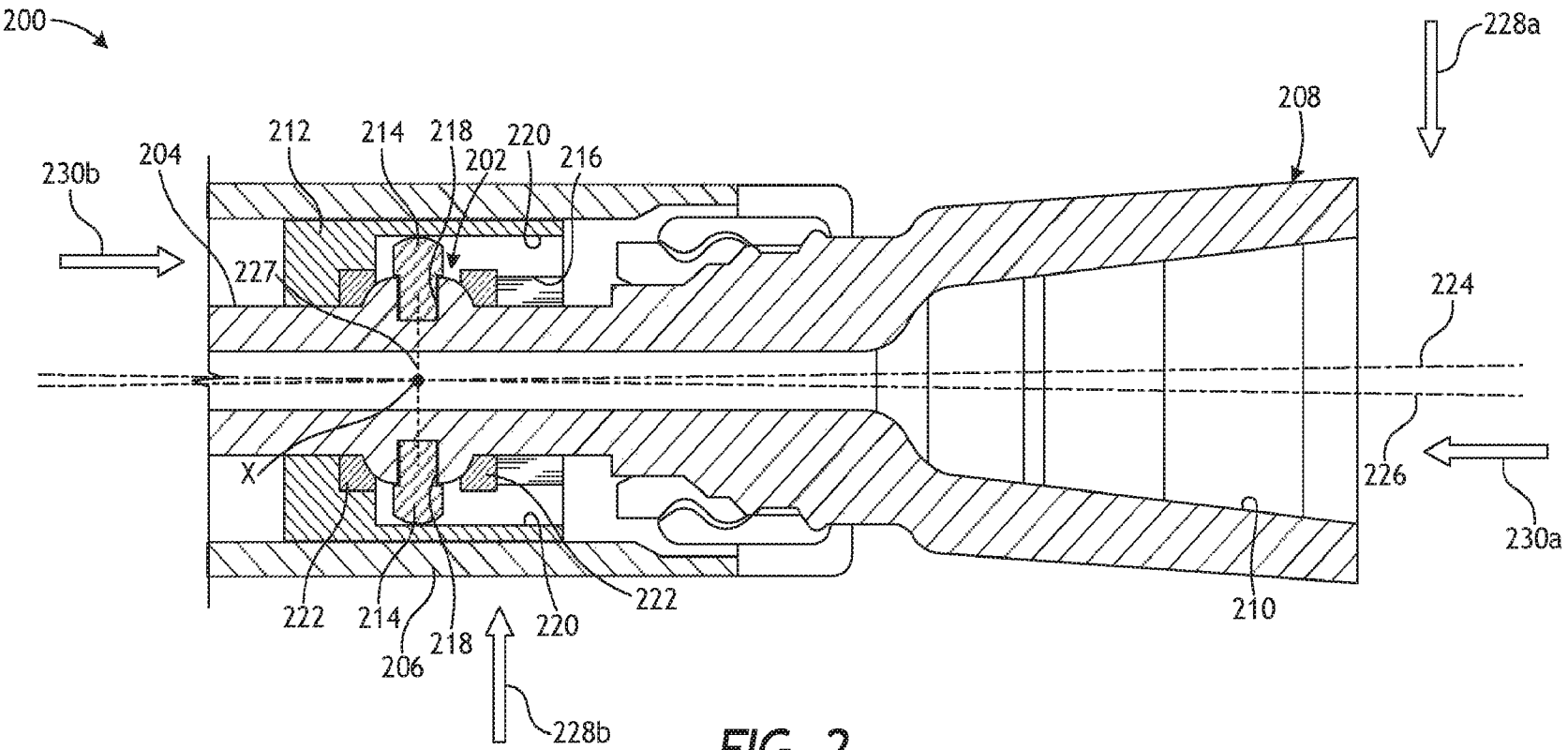
FIG. 2 is a cross-sectional side view of an example steering assembly that includes an articulated joint.

FIG. 2 is a cross-sectional side view of a portion of an example steering assembly 200 that includes an articulated joint 202 (alternately referred to as a "constant velocity" or "universal" joint), according to one or more embodiments of the present disclosure. The steering assembly 200 may be the same as or similar to the steering assembly 128 of FIG. 1 and, therefore, may be used to control drilling direction of the well system 100 (FIG. 1). As illustrated, the steering assembly 200 includes a drive shaft 204 that extends into or is otherwise extendable within an outer housing 206. The outer housing 206 may be coupled to a drill string (e.g., the drill string 120 of FIG. 1) for rotation therewith or alternatively coupled to a mud motor (e.g., the downhole drilling motor 130 of FIG. 3) operable to rotate the outer housing 206.

A bit box 208 may be positioned at the distal end of the drive shaft 204 and may provide a box end 210 configured to receive a threaded pin end of a drill bit (e.g., the drill bit 126 of FIG. 1). Once a drill bit is coupled to the drive shaft 204 at the bit box 208, rotation of the drive shaft 204 will correspondingly rotate the drill bit. The bit box 208 may form an integral extension of the drive shaft 204, but could alternatively be coupled to the drive shaft 204, such as via a threaded connection, one or more mechanical fasteners, or the like.

The articulated joint 202 is located along the axial length of the drive shaft 204 and serves as a pivot point for the drive shaft 204. In the illustrated embodiment, the articulated joint 202 is depicted as a key-style constant-velocity (CV) joint that includes a joint housing 212 and one or more torque transfer features 214 (two shown) configured to transfer torsional loads between the outer housing 206 and the drive shaft 204. In some embodiments, the joint housing 212 may comprise a separate and independent structural component coupled to an inner wall of the outer housing 206. In other embodiments, however, the joint housing 212 may comprise an integral part of the outer housing 206 and otherwise consist of a machined portion of the outer housing 206, without departing from the scope of the disclosure. In either case, the joint housing 212 defines a central passage 216 through which the drive shaft 204 can extend. While only two torque transfer features 214 are shown in FIG. 2, more or less than two torque transfer features 214 may be employed in the articulated joint 202.

The torque transfer features 214 are depicted in FIG. 2 in the form of keys or lugs, but could alternatively take other forms (e.g., gear teeth, ball bearings, etc.), without departing from the scope of the disclosure. Each torque transfer feature 214 may be configured to be received within a corresponding pocket 218 defined in the drive shaft 204 and extend radially outward therefrom to be received within a corresponding housing slot 220 defined in the joint housing 212. The housing slots 220 may comprise at least one planar, longitudinal surface that functions as a torque interface between the torque transfer features 214 and the joint housing 212. Once a given torque transfer feature 214 is received within a pocket 218 and a corresponding housing slot 220, torsional loads may be transferred between the outer housing 206 and the drive shaft 204 via the given torque transfer feature 214. The torsional load transferred from the outer housing 206 to the drive shaft 204 is transmitted to the bit box 208 to rotate a drill bit (not shown) coupled thereto and thereby cause the drill bit to drill a borehole.

In some embodiments, as illustrated, the articulated joint 202 may further include a pair of thrust washers 222 positioned about the drive shaft 204 and axially spaced from each other on opposing axial sides of the torque transfer features 214. The thrust washers 222 may be configured to interpose portions of the drive shaft 204 and the joint housing 212 and transfer axial loads assumed by the drive shaft 204 to the outer housing 206 during drilling operations. The thrust washers 222 may also assume axial loads while running the steering assembly 200 downhole and pulling the steering assembly 200 back out of the wellbore. In the illustrated embodiment, the thrust washers 222 provide and otherwise define concave inner surfaces configured to mate with dimensionally similar convex portions of the drive shaft 204. The complimentary and cooperative curved surfaces of the thrust washers 222 and the drive shaft 204 allow the drive shaft 204 to contact the thrust washers 222 and transmit axial loads without damaging the drive shaft 204 and simultaneously allowing the drive shaft 204 to pivot at the articulated joint 202 without binding or becoming stuck.

The articulated joint 202 enables the drive shaft 204 to move around an indefinite number of axes having a center point X, analogous to a ball and socket joint. The center point X functions as a pivot point for the drive shaft 204 as the articulated joint 202 facilitates articulation (adjustment) of a longitudinal axis 224 of the drive shaft 204 relative to a longitudinal axis 226 of the outer housing 206 and a tilt axis 227 that is orthogonal to the longitudinal axis 224. The axes 224, 226, 227 all converge at the center point X irrespective of any relative angular offset between the longitudinal axes 224, 226 within a selected angular range consistent with normal operational limits of downhole motors. This coincidence of axes 224, 226, 227 at the center point X is beneficial to prevent or inhibit the development of secondary bending moments in the outer housing 206.

In operation, the drive shaft 204 will rotate about its longitudinal axis 224, which may be adjusted relative to the longitudinal axis 226 of the outer housing 206 and the tilt axis 227 to steer the drilling assembly in a desired trajectory. When the drive shaft longitudinal axis 224 is offset from the outer housing longitudinal axis 226, the steering assembly 200 may comprise a counter-rotating force or another mechanism that interacts with the drive shaft 204 to maintain the angular orientation of the bit box 208. The drive shaft 204 may pivot about the articulated joint 202 while torque is being transmitted though the articulated joint 202 to maintain the angular orientation of the bit box 208.

During drilling operations, the steering assembly 200 may be subject to torsional, axial, and/or radial forces that must be accommodated by the articulated joint 202 for the steering assembly 200 to function properly. A first radial force 228*a*, for example, may be imparted on the steering assembly 200 when a drill bit attached to the bit box 208 contacts a side of a borehole in a steering operation. An opposite, second radial force 228*b* may be assumed at the articulated joint 202. Similarly, the steering assembly 200 may be subject to opposing axial forces 230*a* and 230*b* due to the interaction with the bottom of a borehole and the weight of the drill string above the drilling assembly. These axial forces 230*a,b* also may be transmitted or absorbed through the articulated joint 202 at the thrust washers 222, as generally described above.

According to the present disclosure, the articulated joint 202 may be designed and otherwise configured such that the torque transfer features 214 more evenly share torque loading during operation as compared to conventional or prior art articulated joints. Assuming that the torque transfer features 214 are made of an infinitely rigid material, a conventional or prior art articulated joint can only transmit torque through two points if the outer housing 206 and the drive shaft 204 are tilted at any angle other than zero. This is due to geometry of the articulated joint since it is only possible for contact in one plane relative to the tilt axis 227. For the articulated joint 202 to properly operate, it must be able to rotate about the orthogonally-positioned longitudinal and tilt axes 224, 227. Orientations occur where the torque transfer features 214 are forced to pivot about an axis other than the perpendicular longitudinal and tilt axes 224, 227. When this occurs, a torque feature that is closer to the tilt axis 227 will move along a smaller radius as compared to a torque transfer feature 214 with a radius further from the tilt axis 227, which may cause binding in the articulated joint 202. This is true for not only conventional key-style CV joints, but also for conventional ball and gear style CV joints.

In actuality, however, the torque transfer features 214 are not made of infinitely rigid materials, but react like stiff springs during operation of the steering assembly 200. Consequently, it may be possible to have contact at more than two points if 1) the tolerance between the torque transfer features 214 and the corresponding pocket 218 is tight, 2) the articulation angle is relatively small, and 3) the design of the articulated joint 202 is flexible (i.e., low stiffness) so that the torque transfer features 214 are able to deform and provide multiple contact points. Regarding 1), the tolerance between the torque transfer features 214 and the corresponding pocket 218 must be tight enough so that as the material is stressed, the strain in the material deforms and contacts additional locations as the loads increase. Regarding 2), the larger the articulation angle, the more clearance is required between additional contact points such that the joint does not bind. Regarding 3), the stiffness of the material must be flexible enough that at the operating loading conditions the gap can be closed. This can negatively affect the maximum loading capacity of the articulated joint 202.

The embodiments of the articulated joint 202 disclosed herein separate the spring-like capability of the torque transfer features 214 from the geometry of the torque transferring mechanism. More specifically, instead of attempting to design a torque transferring mechanism that meets geometry requirements and is also flexible enough to distribute loads to an increased number of torque transfer features 214 (which would require design compromises), the embodiments provided herein allow these two requirements to be designed and optimized independent from each other. Advantageously, the embodiments provided herein are able to still achieve the same or higher loading capacity of an articulated joint without the design compromises in standard joint designs. This will allow potentially less exact or "looser" tolerances of the joint to be designed, or higher articulation angles to be achieved while still maintaining the desired load capacity.

Figure 3:
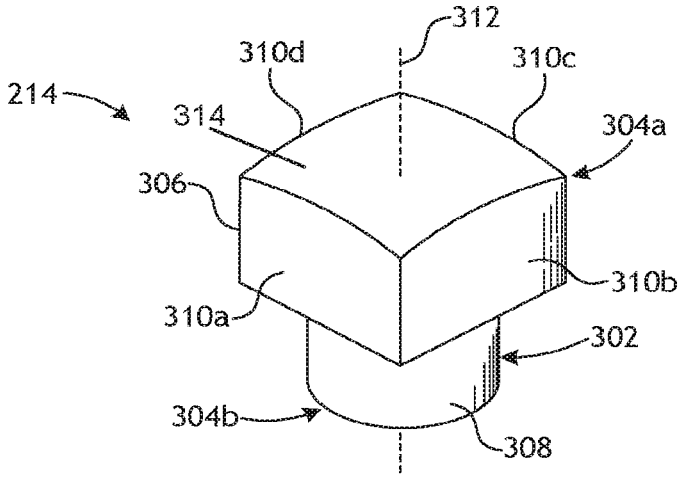
FIG. 3 is an isometric view of an example torque transfer feature.

FIG. 3 is an isometric view of an example torque transfer feature 214, according to one or more embodiments of the present disclosure. As illustrated, the torque transfer feature 214 includes an elongate body 302 having a first end 304*a* and a second end 304*b* opposite the first end 304*a*. The body 302 defines and otherwise provides a head 306 at the first end 304*a* and a shank 308 extends from the head 306 towards the second end 304*b*.

In the illustrated embodiment, the head 306 comprises four planar surfaces, shown as planar surfaces 310*a*, 310*b*, 310*c*, and 310*d*, where planar surfaces 310*a* and 310*c* are parallel to each other and planar surfaces 310*b* and 310*d* are parallel to each other. In some embodiments, the head 306 may be configured to be received within a corresponding housing slot 220 (FIG. 2) defined in the joint housing 212 (FIG. 2). In other embodiments, however, the orientation of the torque transfer feature 214 may be reversed and the head 306 may alternatively be configured to be received within a corresponding slot defined in the drive shaft 204 (FIG. 2), without departing from the scope of the disclosure. In embodiments where the head 306 is received into the housing slot 220, one of the planar surfaces 310*a-d* engages a sidewall of the housing slot 220 and thereby facilitates torque transfer between the drive shaft 204 and the outer housing 206 (FIG. 2) via the joint housing 212. In embodiments where the joint housing 212 comprises an integral part of the outer housing 206, as mentioned above, the housing slots 220 will be defined in the internal surfaces of the outer housing 206 and the torque will be transferred directly between the drive shaft 204 and the outer housing 206. Since torque will generally be applied in a single angular direction during operation, in alternate embodiments, the head 306 may include or otherwise define only a single planar surface engageable with the sidewall of the housing slot 220 to transfer torque resulting from rotation of outer housing 206 in a single angular direction.

The shank 308 is a cylindrical structure sized to be received within a corresponding pocket 218 (FIG. 2) defined in the drive shaft 204 (FIG. 2). In other embodiments, however, the orientation of the torque transfer feature 214 may be reversed and the shank 308 may alternatively be configured to be received within a pocket defined in the joint housing 212 (FIG. 2), without departing from the scope of the disclosure. The shank 308 and the pocket 218 may be cooperatively sized to facilitate a tight fit that nonetheless allows the torque transfer feature 214 to rotate or swivel about a central axis 312.

In some embodiments, the top 314 of the head 306 may comprise a convexly spherical bearing surface. As used herein, the term "spherical surface" refers to a surface that forms a portion of the surface of a sphere, but not the entire surface of a sphere. During operation, the top 314 of the head may be engageable with a ceiling surface of a corresponding housing slot 220 (FIG. 2) defined in the joint housing 212 (FIG. 2). As the articulated joint 202 (FIG. 2) rotates about the center point X (FIG. 2), the convexly spherical top 314 may slidingly engage the ceiling surface of the corresponding housing slot 220. In other embodiments, however, the top 314 need not comprise a convexly spherical bearing surface. Moreover, the second end 304*b* of the torque transfer feature 214 will also act as a bearing surface as engaged against the bottom of the corresponding pocket 218 (FIG. 2) in the driveshaft 204 (FIG. 2). Having this loaded face to face contact prevents the central axis 312 from tilting away from the from the tilt axis 227 (FIG. 2), which provides enhanced contact between torque carrying surfaces as well as the elastic mounts described herein below.

Figure 4:
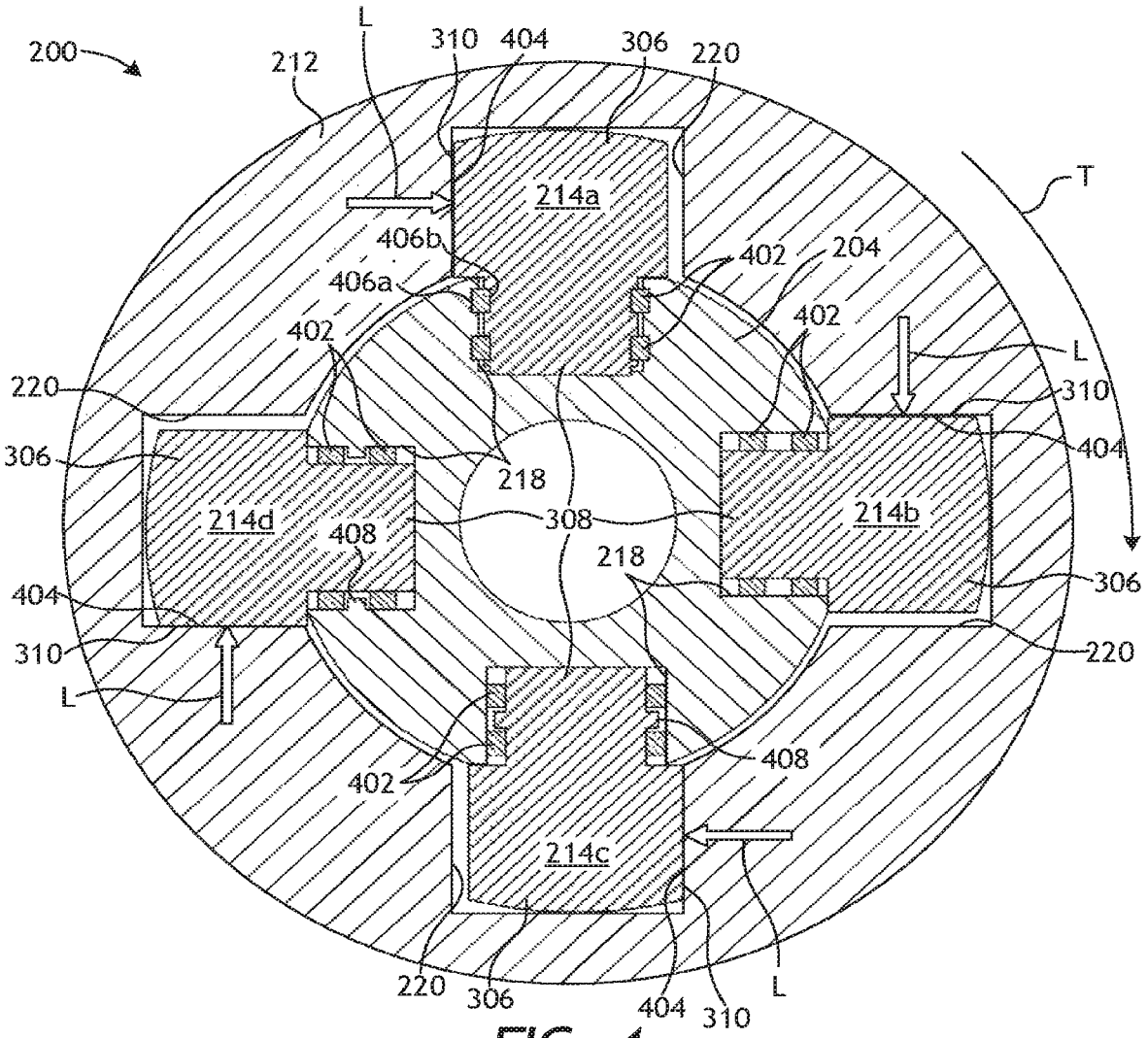
FIG. 4 is a cross-sectional side view of the articulated joint of FIG. 2.

FIG. 4 is a cross-sectional side view of the articulated joint 202 of FIG. 2, according to one or more embodiments. As illustrated, the articulated joint 202 includes four torque transfer features equidistantly spaced from each other about the circumference of the drive shaft 204 and labeled as a first torque transfer feature 214*a*, a second torque transfer feature 214*b*, a third torque transfer feature 214*c*, and a fourth torque transfer feature 214*d*. While four torque transfer features 214*a-d* are depicted in FIG. 4, more or less than four (i.e., two, three, or more than four) may alternatively be employed, without departing from the scope of the disclosure. Each torque transfer feature 214*a-d* includes a head 306 received into a corresponding housing slot 220 defined in the joint housing 212, and a shank 308 received into a corresponding pocket 218 defined in the drive shaft 204.

As illustrated, one or more elastic mounts 402 may be positioned or otherwise located within each pocket 218 to compliantly mount each torque transfer feature 214*a-d* therein. In the illustrated embodiment, two elastic mounts 402 are positioned within each pocket 218, but more or less than two elastic mounts 402 may alternatively be employed in each pocket, without departing from the scope of the disclosure. The elastic mounts 402 generally interpose the outer cylindrical surface of the shank 308 and the opposing inner cylindrical surface of the pocket 218 but allow each torque transfer feature 214*a-d* to rotate about its corresponding central axis 312 (FIG. 3).

The elastic mounts 402 may be made of a compliant or flexible material, thereby allowing the torque transfer features 214*a-d* to "float" within the corresponding pocket 218 during operation as torque loads are transferred between the joint housing 212 and the drive shaft 204 via the torque transfer features 214*a-d*. Suitable materials for the elastic mounts 402 include, but are not limited to, a plastic (e.g., PEEK or PTFE), an elastomer (e.g., VITON®, HNBR, a hard rubber like ebonite, etc.), a soft metal (e.g., copper, beryllium copper, brass, titanium, etc.), steel (e.g., exhibiting low stiffness geometry, such as a leaf spring or a coil), a pliable composite material, and any combination thereof.

The spring rate or modulus of elasticity of the elastic mounts 402 allows the torque transfer features 214*a-d* to translate (move) a short distance within the corresponding pocket 218, which allows torque transfer between the joint housing 212 and the drive shaft 204 at diverse angular locations. More particularly, in conventional articulated joints, two angularly opposite torque transfer features (e.g., the first and third torque transfer features 214*a,c* or the second and fourth torque transfer features 214*c,d*) typically assume the majority of the torque transferred between the joint housing 212 and the drive shaft 204. Transferring torque through angularly adjacent torque transfer features, however, requires the torque transfer features to deform, which can often result in interference or binding in the articulated joint 202 and could cause the drive shaft 204 to back rotate. Employing the elastic mounts 402, however, provides an amount of give in each pocket 218 that allows each torque transfer feature 214*a-d* to shift (move) slightly within its corresponding pocket 218 and thereby simultaneously assume an amount of the torque applied from the joint housing 212.

In the illustrated embodiment, for example, torque is applied in the clockwise direction from the joint housing 212 (i.e., the outer housing 206 of FIG. 2) to the drive shaft 204, as indicated by the arrow T. In response to the applied torque loading T, a corresponding tangential load is applied to each torque transfer feature 214*a-d*, as indicated by the arrows L. This is possible since the elastic mounts 402 flex (give) under pressure and thereby allow each torque transfer feature 214*a-d* to shift until a planar surface 310 of the head 306 of each torque transfer feature 214*a-d* engages an opposing sidewall 404 of the corresponding housing slot 220. Upon engaging the planar surface 310 of the head 306 against the opposing sidewall 404, the tangential load L will be transferred between the joint housing 212 and the drive shaft 204 via each torque transfer feature 214*a-d*. Accordingly, the compliant nature of the elastic mounts 402 helps distribute the torque loading T across all torque transfer feature 214*a-d*.

The spring rate or coefficient of elasticity of the elastic mounts 402 may be selected, adjusted, and otherwise tuned to more evenly distribute the torque loading T across all torque transfer features 214*a-d*. For instance, different materials may be selected to adjust the spring rate of the elastic mounts 402 to a predetermined or desired spring rate. In other embodiments, the spring rate of a specific material of the elastic mounts 402 may vary (e.g., increase) during travel of the torque transfer feature 214. In addition, different designs, configurations, and/or arrangements of the elastic mounts 402 may be employed to tune the spring rate or coefficient of elasticity of the elastic mounts 402. For example, the elastic mounts 402 are depicted in FIG. 4 as annular rings having a generally polygonal (e.g., square, rectangular, etc.) cross-section. In other embodiments, however, the elastic mounts 402 may alternately exhibit other cross-sectional shapes, such as circular or ovoid. Moreover, while depicted in FIG. 4 as comprising a generally solid structure, one or more of the elastic mounts 402 may comprise a hollow or partly structure that attains a desired spring rate or travel of the torque transfer feature 214*a-d* within the corresponding pocket 218. In such embodiments, the hollow elastic mount 402 may comprise a honeycomb or corrugated structure, for example.

The elastic mounts 402 may be arranged within the pockets 218 in a variety of configurations, without departing from the scope of the disclosure. In some embodiments, for instance, the elastic mounts 402 may be molded about the outer circumference of the shank 308, but could alternatively be molded to the inner circumference of the pocket 218. In some embodiments, as shown at the first torque transfer feature 214*a*, the elastic mounts 402 may be positioned within opposing annular grooves 406*a* and 406*b* defined in both the pocket 218 and the shank 308, respectively. In other embodiments, however, the elastic mounts 402 may be positioned within a single annular groove defined in either the pocket 218 or the shank 308. In yet other embodiments, as shown at the second torque transfer feature 214*b*, the elastic mounts 402 may simply interpose the inner wall of the pocket 218 and the outer circumference of the shank 308 without being positioned within an annular groove.

In some embodiments, one or more hard stops 408 may be used to prevent overloading the elastic mounts 402 during operation. Such hard stops 408 may prove advantageous in limiting the amount of deflection (movement) the torque transfer features 214*a-d* can assume during operation and, consequently, may help prevent compressing or crushing the elastic mounts 402 beyond their elastic limit. With reference to the third torque transfer feature 214*c*, for example, a hard stop 408 may be defined on or otherwise provided by the shank 308. The hard stop 408 at the third torque transfer feature 214*c* is depicted as an annular protrusion of the shank 308 that exhibits a diameter greater than the remaining portions of the shank 308. When the third torque transfer feature 214*c* shifts toward the inner wall of the pocket 218 during operation, the hard stop 408 will engage the inner wall of the pocket 218 and stop lateral movement of the third torque transfer feature 214*c*. In other embodiments, as shown at the fourth torque transfer feature 214*d*, the hard stop 408 may be defined on or otherwise provided by the inner wall of the pocket 218 and comprise an annular protrusion that exhibits a diameter that is less than the remaining portions of the pocket 218. When the fourth torque transfer feature 214*d* shifts toward the inner wall of the pocket 218 during operation, the shank 308 will engage the hard stop 408, which stops lateral movement of the fourth torque transfer feature 214*d*.

While being depicted as positioned axially between the elastic mounts 402, the hard stops 408 may be positioned at other locations within the pocket 218, without departing from the scope of the disclosure. In some embodiments, for example, the hard stop 408 may alternatively be positioned axially above or below the elastic mounts 402 within the pocket 218. Moreover, while depicted as being defined on either the shank 308 or the inner wall of the pocket 218, the hard stop 408 may alternatively comprise a separate structure or device positioned within the pocket. In such embodiments, for example, the hard stop 408 may comprise a bushing or the like positioned at various locations within the pocket 218. In some embodiments, the bushing-type hard stop 408 may axially interpose the elastic mounts 408, but could alternatively be positioned axially above or below the elastic mounts 402 within the pocket 218.

Figure 5:
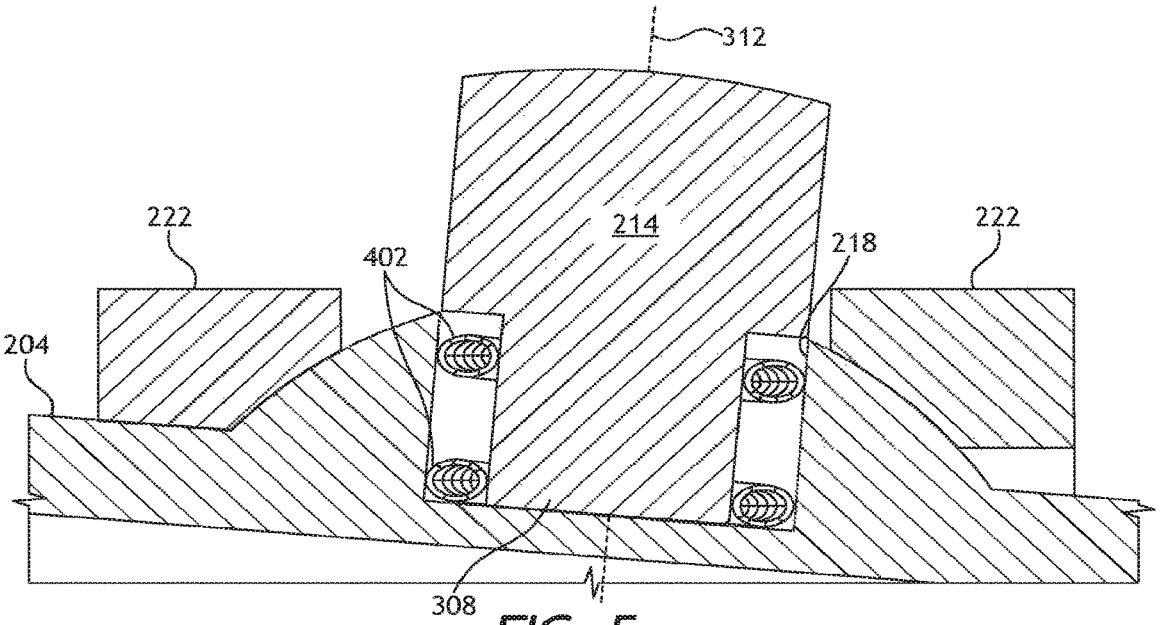
FIG. 5 is a cross-sectional side view of another example arrangement of a torque transfer feature and corresponding elastic mounts.

FIG. 5 is a cross-sectional side view of another example arrangement of a torque transfer feature 214 and corresponding elastic mounts 402, according to one or more embodiments. As illustrated, the torque transfer feature 214 has the shank 308 received within and otherwise extended into a corresponding pocket 218 of the drive shaft 204, and a pair of thrust washers 222 are positioned on opposing axial sides of the torque transfer feature 214 and engaging the drive shaft 204, as generally described above.

In the illustrated embodiment, the elastic mounts 402 each comprise a canted coil spring (alternately referred to as a slanted spring) positioned within the pocket 218 and interposing the outer cylindrical surface of the shank 308 and the opposing inner cylindrical surface of the pocket 218. The canted spring-type elastic mount 402 operates similar to the other embodiments described herein by providing an amount of give in the pocket 218 that allows the torque transfer feature 214 to shift (move) slightly within the pocket 218 while simultaneously allowing the torque transfer feature 214 to rotate about its central axis 312. While not shown, one or more hard stops may be included in the depicted embodiment and otherwise interpose the shank 308 and the inner cylindrical surface of the pocket 218 to limit the amount of deflection (movement) the torque transfer feature 214 can assume during operation. In such embodiments, the hard stop features may also prove advantageous in holding the canted spring-type elastic mounts 402 in place.

Figure 6:
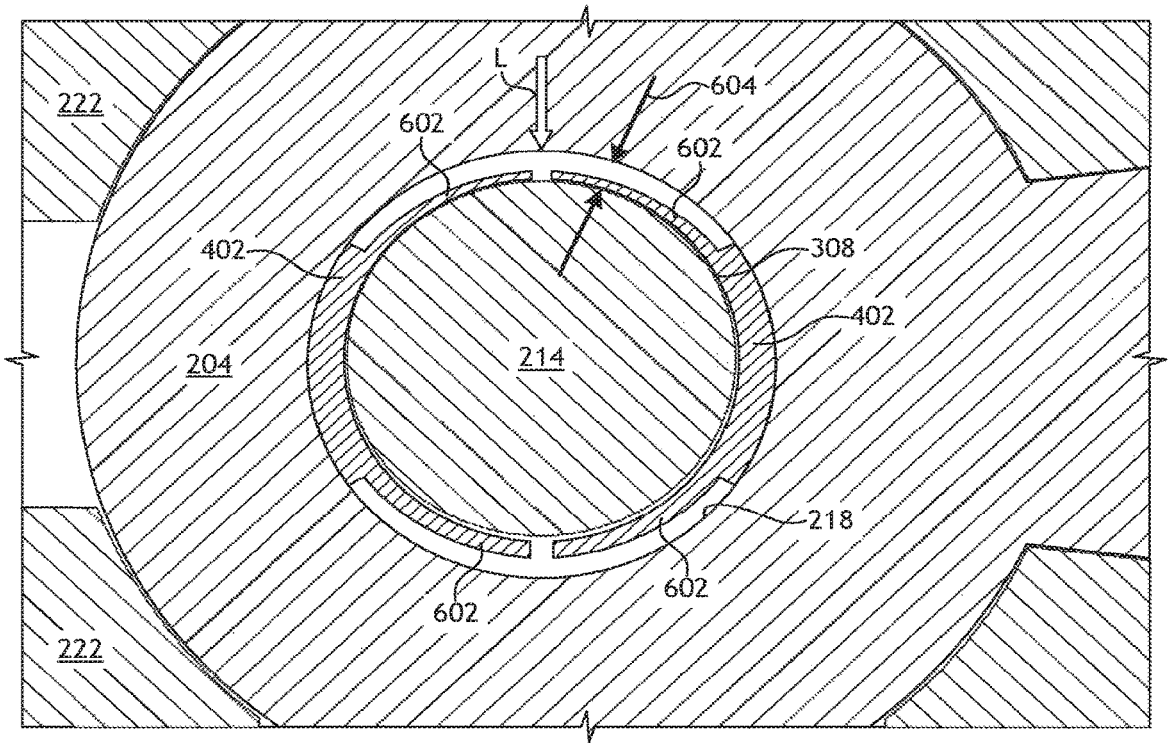
FIG. 6 is a cross-sectional end view of another example arrangement of a torque transfer feature and corresponding elastic mounts.

FIG. 6 is a cross-sectional end view of another example arrangement of a torque transfer feature 214 and corresponding elastic mounts 402, according to one or more additional embodiments. The view of FIG. 6 is taken as a horizontal cross-section through the shank 308 of the torque transfer feature 214 and through a portion of the drive shaft 204 and axially adjacent thrust washers 222.

In the illustrated embodiment, the elastic mounts 402 each comprise a cantilever-type spring bushing positioned within the pocket 218 and interposing the outer cylindrical surface of the shank 308 and the opposing inner cylindrical surface of the pocket 218. Each cantilever spring bushing has a pair of arcuate extensions 602 extending in opposing angular directions that facilitate a leaf spring configuration. In operation, the arcuate extensions 602 facilitate an amount of give in the pocket 218 that allows the torque transfer feature 214 to shift (move) slightly within the pocket 218 across a gap 604 upon assuming a tangential load L resulting from torque loading T (FIG. 4). Moreover, the arcuate extensions 602 may exhibit a thickness that acts as a type of hard stop that limits the amount of deflection (movement) the torque transfer feature 214 can assume during operation and thereby helps prevent compressing the arcuate extensions 602 beyond their elastic limit.

Figure 7:
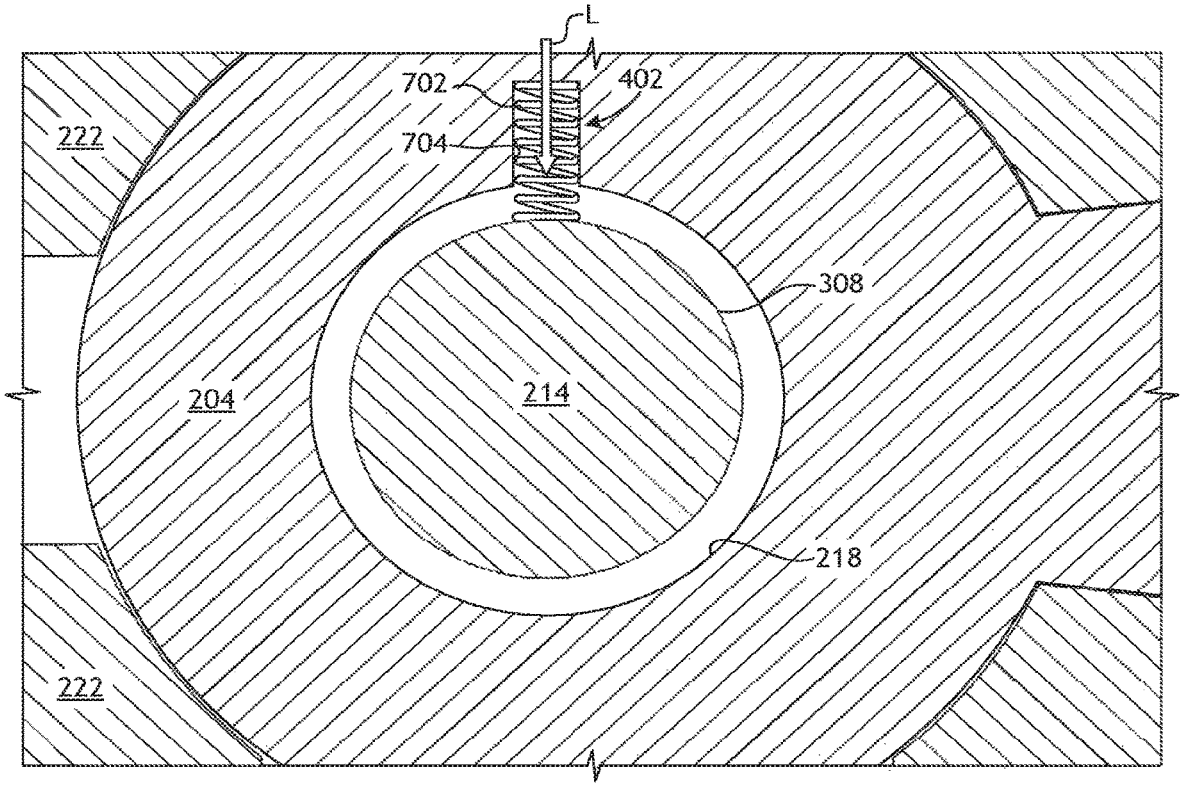
FIG. 7 is a cross-sectional end view of another example arrangement of a torque transfer feature and an elastic mount.

FIG. 7 is a cross-sectional end view of another example arrangement of a torque transfer feature 214 and an elastic mount 402, according to one or more additional embodiments. The view of FIG. 7 is similar to the view of FIG. 6 and shows a horizontal cross-section through the shank 308 of the torque transfer feature 214 and through a portion of the drive shaft 204 and axially adjacent thrust washers 222.

In the illustrated embodiment, the elastic mount 402 comprises a biasing device 702 positioned within a cross-bore 704 defined in the drive shaft 204 and opening into the pocket 218. In some embodiments, as illustrated, the biasing device 702 may be a coil or compression spring, but may alternatively comprise a series of Belleville washers or the like. The biasing device 702 may be configured to engage the outer cylindrical surface of the shank 308. In operation, upon assuming a tangential load L resulting from torque loading T (FIG. 4), the biasing device 702 facilitates an amount of give in the pocket 218 that allows the torque transfer feature 214 to shift (move) slightly within the pocket 218 while simultaneously allowing the torque transfer feature 214 to rotate about its central axis.

While not shown, one or more hard stops may be included in the depicted embodiment and otherwise interpose the shank 308 and the inner cylindrical surface of the pocket 218 to limit the amount of deflection (movement) the torque transfer feature 214 can assume during operation. Alternatively, the inner wall of the pocket 218 may serve as a type of hard stop as the shank 308 compresses the biasing device 702 sufficiently to engage the opening of the cross-bore 704, which will stop further travel of the torque transfer feature 214 within the pocket 218. Moreover, while only one elastic mount 402 is shown in the embodiment of FIG. 7, more than one elastic mount 402 in the form of the biasing device 702 may be employed, without departing from the scope of the disclosure. In such embodiments, the additional elastic mounts 402 may be positioned within corresponding cross-bores 704 defined in the drive shaft 204 and angularly spaced from each other by equidistant or non-equidistant measures.

Figure 8A:
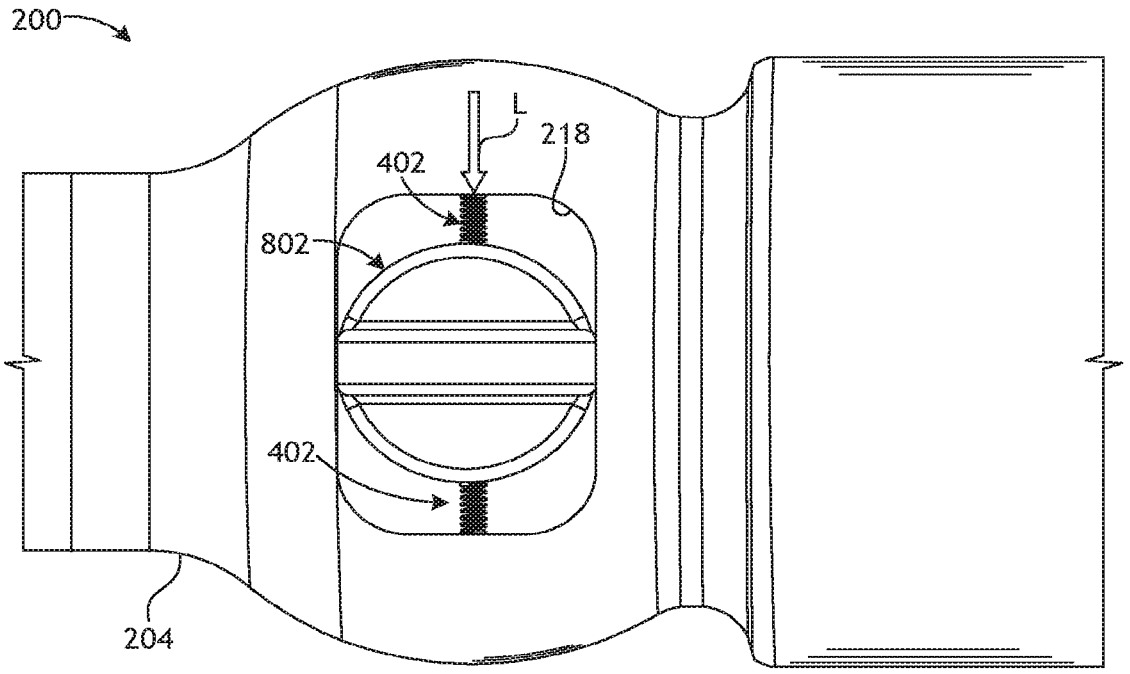
FIG. 8A is a top plan view of another embodiment of the articulated joint.

FIG. 8A is a top plan view of another embodiment of the articulated joint 200, according to one or more additional embodiments. In the illustrated embodiment, instead of a generally cylindrical bore defined in the drive shaft 204, the pocket 218 comprises a machined slot sized to receive an alternative design torque transfer feature 802. The slot-like pocket 218 is sized to accommodate the width of the shank of the torque transfer feature 802, but is open (i.e., longer) in the direction of a tangential load L resulting from torque loading T (FIG. 4). Consequently, the articulated joint 200 may be designed to only accommodate motion in the direction of torque tangential load L.

One or more elastic mounts 402 (two shown) may be positioned within the pocket 218 to allow compliance in the direction of the tangential load L. In the illustrated embodiment, the elastic mounts 402 are similar to the biasing device 702 of FIG. 6, but could alternatively comprise any of the elastic mounts 402 described herein. With two elastic mounts 402 included in the pocket 218, compliance is allowed opposing tangential load L directions. The length of the slot-like pocket 218 allows the torque transfer feature 802 to travel within the pocket 218 as the elastic mounts 402 act thereon. Having two elastic mounts 402 may prove advantageous in providing different spring rates in opposite directions of torque. In other embodiments, however, only one elastic mount 402 need be employed to provide compliance in only one direction. Such embodiments may prove advantageous in making the design more compact.

Figure 8B:
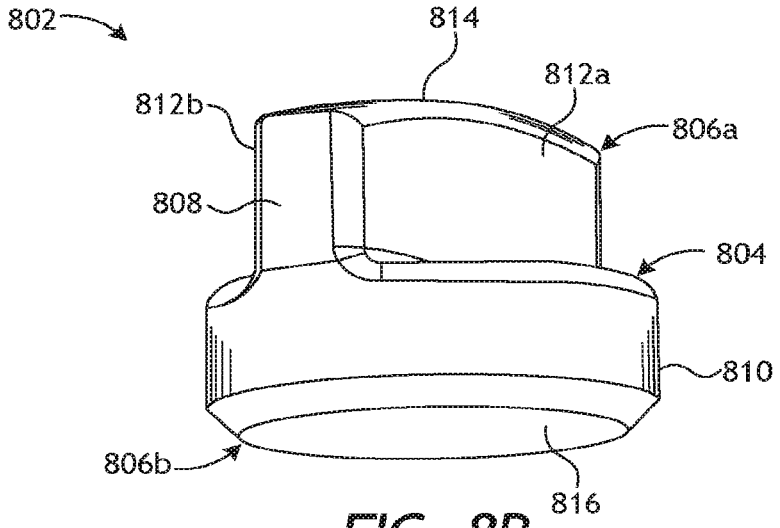
FIG. 8B is an isometric view of the torque transfer feature of FIG. 8A.

FIG. 8B is an isometric view of the torque transfer feature 802 of FIG. 8A, according to one or more embodiments of the present disclosure. The purpose of the torque transfer feature 802 is the same as the torque transfer feature 214 discussed above and depicted in FIG. 3. Similar to the torque transfer feature 214 of FIG. 3, for example, the torque transfer feature 802 includes an elongate body 804 having a first end 806*a* and a second end 806*b* opposite the first end 806*a*. The body 804 defines and otherwise provides a head 808 at the first end 806*a* and a shank 810 extends from the head 808 towards the second end 806*b*.

In the illustrated embodiment, the head 808 is generally in the form of a tab or extension that includes two generally planar surfaces 812*a* and 812*b*, where planar surfaces 812*a,b* are parallel to each other. The head 808 may be configured to be received within a corresponding housing slot 220 (FIG. 2) defined in the joint housing 212 (FIG. 2). In such embodiments, one of the planar surfaces 810*a,b* engages a sidewall of the housing slot 220 and thereby facilitates torque transfer between the drive shaft 204 (FIG. 8A) and the outer housing 206 (FIG. 2). Since torque will generally be applied in a single angular direction during operation, in alternate embodiments, the head 808 may include or otherwise define only a single planar surface engageable with the sidewall of the housing slot 220 to transfer torque resulting from rotation of outer housing 206 in a single angular direction.

In some embodiments, as illustrated, the top 814 of the head 808 may comprise a convex bearing surface. During operation, the top 814 of the head may be engageable with a ceiling surface of a corresponding housing slot 220 (FIG. 2) defined in the joint housing 212 (FIG. 2). As the articulated joint 802 (FIG. 8A) rotates about the center point X (FIG. 2), the convexly spherical top 814 may slidingly engage the ceiling surface of the corresponding housing slot 220. In other embodiments, however, the top 814 need not comprise a convexly spherical bearing surface.

The shank 810 comprises a cylindrical or disk-shaped member having a generally planar bottom surface 816. The diameter of the head 808 is sized to be received within the slot-like pocket 218 of FIG. 8A. The bottom surface 816 may act as a bearing surface engageable against the bottom of the corresponding pocket 218.

Figure 9:
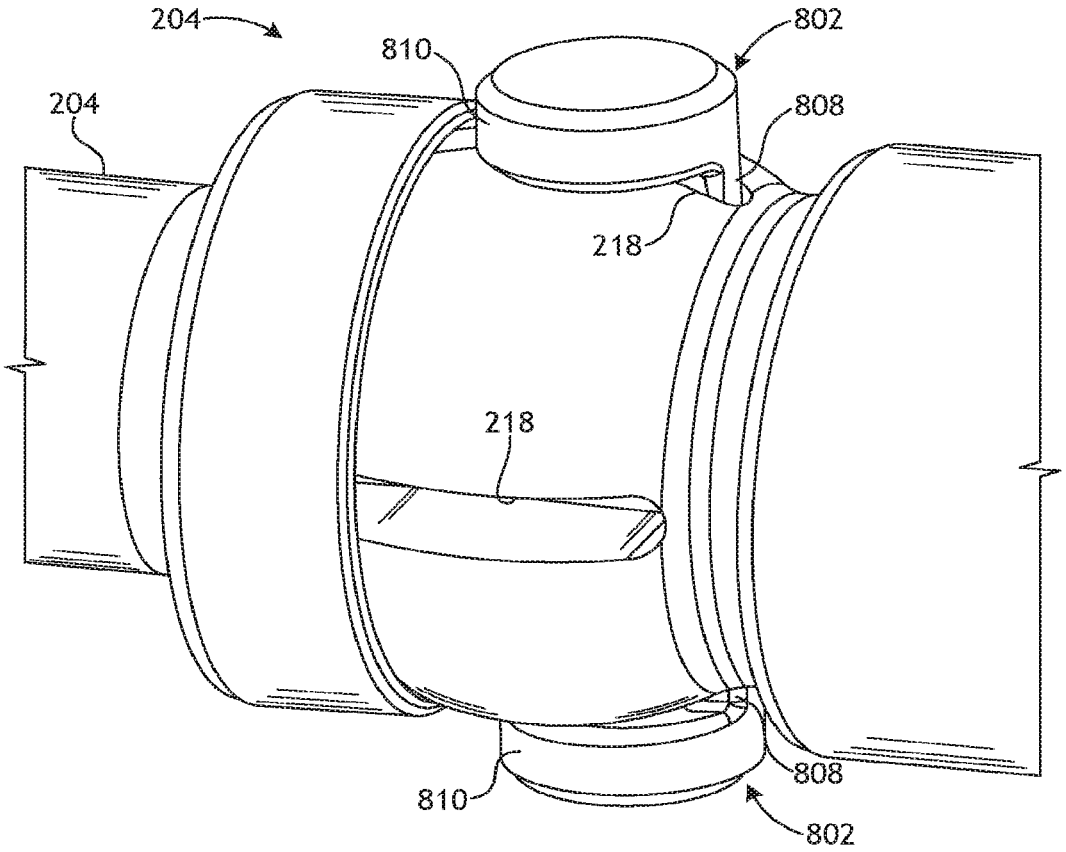
FIG. 9 is an isometric view of yet another embodiment of the articulated joint.

FIG. 9 is an isometric view of yet another embodiment of the articulated joint 200, according to one or more additional embodiments. In the illustrated embodiment, the orientation of the torque transfer features 802 is reversed such that the head 808 of each torque transfer feature 802 is received within the pocket 218 defined in the drive shaft 204, and the shank 810 extends out of the pocket 218. As illustrated, each pocket 218 is in the form of an elongate slot sized to receive the head 808 of each torque transfer feature 802. Moreover, in such embodiments, the shank 810 may be received into a corresponding housing slot 220 (FIG. 2) that is sized to receive the cylindrical geometry of the shank 810.

Embodiments disclosed herein include:

A. A steering assembly that includes an outer housing, a drive shaft extended longitudinally within the outer housing and defining a plurality of pockets, a plurality of torque transfer features, each torque transfer feature including a shank received within a corresponding one of the plurality of pockets to transfer torsional loads from the outer housing to the drive shaft, and one or more elastic mounts positioned within each pocket and interposing the shank and an inner wall of each pocket.

B. A method of operating a downhole steering assembly that includes rotating an outer housing of the downhole steering assembly and thereby generating a torsional load, transferring the torsional load to a drive shaft extended longitudinally within the outer housing via a plurality of torque transfer features, each torque transfer feature including a shank received within a corresponding one a plurality of pockets defined in the drive shaft, and distributing a portion of the torsional load to each torque transfer feature using one or more elastic mounts positioned within each pocket and interposing the shank and an inner wall of each pocket.

Each of embodiments A and B may have one or more of the following additional elements in any combination: Element 1: further comprising a joint housing secured within the outer housing and defining a plurality of housing slots, wherein each torque transfer feature further includes a head received within a corresponding one of the plurality of housing slots. Element 2: wherein each housing slot defines a planar, longitudinal surface engageable with a planar surface defined on the head of each torque transfer feature. Element 3: wherein the one or more elastic mounts allow rotation of the plurality of torque transfer features about a central axis of each torque transfer feature. Element 4: wherein the one or more elastic mounts comprise a compliant material selected from the group consisting of a plastic, an elastomer, a soft metal, steel, a pliable composite material, and any combination thereof. Element 5: wherein the one or more elastic mounts are selected from the group consisting of an annular ring, a canted coil spring, a spring bushing having arcuate extensions extending in opposing angular directions, and a biasing device positioned within a cross-bore defined in the drive shaft and opening into the pocket. Element 6: wherein at least one of the one or more elastic mounts is molded to an outer circumference of the shank of one or more of the plurality of torque transfer features. Element 7: wherein the one or more elastic mounts are positioned within at least one of an annular groove defined on the shank, an annular groove defined on the inner wall of the plurality of pockets, or opposing annular grooves defined on both the shank and the inner wall of the plurality of pockets. Element 8: further comprising one or more hard stops positioned within at least one of the plurality of pockets. Element 9: wherein the one or more hard stops comprises an annular protrusion defined on the shank or the inner wall of the plurality of pockets. Element 10: wherein the one or more hard stops comprises a bushing interposing the shank and the inner wall of the plurality of pockets. Element 11: wherein the shank of at least one of the plurality of torque members comprises a cylindrical structure and the corresponding one of the plurality of pockets comprises a machined slot sized to receive the cylindrical structure.

Element 12: wherein rotating the outer housing of the steering assembly comprises one of rotating the outer housing by rotating a drill string coupled to the outer housing and rotating the outer housing by operating a downhole drilling motor coupled to the outer housing. Element 13: wherein the downhole steering assembly further includes a joint housing secured within the outer housing and defining a plurality of housing slots, and each torque transfer feature further includes a head received within a corresponding one of the plurality of housing slots, and wherein transferring the torsional load to the drive shaft further comprises transferring a tangential load of the torsional load to each torque transfer feature as the head engages the corresponding one of the plurality of housing slots. Element 14: allowing rotation of the plurality of torque transfer features within each pocket with the one or more elastic mounts. Element 15: wherein the one or more elastic mounts comprise a compliant material and distributing the portion of the torsional load to each torque transfer feature comprises flexing the compliant material and thereby allowing each shank to shift within the corresponding one the plurality of pockets and assume the portion of the torsional load. Element 16: further comprising preventing compression of the one or more elastic mounts beyond an elastic limit with one or more hard stops positioned within the plurality of pockets. Element 17: wherein the one or more elastic mounts are selected from the group consisting of an annular ring, a canted coil spring, a spring bushing having arcuate extensions extending in opposing angular directions, and a biasing device positioned within a cross-bore defined in the drive shaft and opening into the pocket. Element 18: further comprising rotating a drill bit operatively coupled to the drive shaft.

By way of non-limiting example, exemplary combinations applicable to A and B include: Element 1 with Element 2; Element 8 with Element 9; and Element 8 with Element 10.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A steering assembly, comprising:

an outer housing of the steering assembly configured to rotate to generate a torsional load;

a drive shaft extended longitudinally within the outer housing and defining a plurality of pockets;

a plurality of torque transfer features, each torque transfer feature including a shank received within a corresponding one of the plurality of pockets to transfer a portion of the torsional loads from the outer housing to the drive shaft; and one or more elastic mounts positioned within each pocket and interposing the shank and an inner wall of each pocket.

2. The steering assembly of claim 1, further comprising a joint housing secured within the outer housing and defining a plurality of housing slots, wherein each torque transfer feature further includes a head received within a corresponding one of the plurality of housing slots.

3. The steering assembly of claim 2, wherein each housing slot defines a planar, longitudinal surface engageable with a planar surface defined on the head of each torque transfer feature.

4. The steering assembly of claim 1, wherein the one or more elastic mounts allow rotation of the plurality of torque transfer features about a central axis of each torque transfer feature.

5. The steering assembly of claim 1, wherein the one or more elastic mounts comprise a compliant material selected from the group consisting of a plastic, an elastomer, a soft metal, steel, a pliable composite material, and any combination thereof.

6. The steering assembly of claim 1, wherein the one or more elastic mounts are selected from the group consisting of an annular ring, a canted coil spring, a spring bushing having arcuate extensions extending in opposing angular directions, and a biasing device positioned within a cross-bore defined in the drive shaft and opening into the pocket.

7. The steering assembly of claim 1, wherein at least one of the one or more elastic mounts is molded to an outer circumference of the shank of one or more of the plurality of torque transfer features.

8. The steering assembly of claim 1, wherein the one or more elastic mounts are positioned within at least one of an annular groove defined on the shank, an annular groove defined on the inner wall of the plurality of pockets, or opposing annular grooves defined on both the shank and the inner wall of the plurality of pockets.

9. The steering assembly of claim 1, further comprising one or more hard stops positioned within at least one of the plurality of pockets.

10. The steering assembly of claim 9, wherein the one or more hard stops comprises an annular protrusion defined on the shank or the inner wall of the plurality of pockets.

11. The steering assembly of claim 9, wherein the one or more hard stops comprises a bushing interposing the shank and the inner wall of the plurality of pockets.

12. The steering assembly of claim 1, wherein the shank of at least one of the plurality of torque members comprises a cylindrical structure and the corresponding one of the plurality of pockets comprises a machined slot sized to receive the cylindrical structure.

13. A method of operating a downhole steering assembly, comprising:

rotating an outer housing of the downhole steering assembly and thereby generating a torsional load;

transferring the torsional load to a drive shaft extended longitudinally within the outer housing via a plurality of torque transfer features, each torque transfer feature including a shank received within a corresponding one a plurality of pockets defined in the drive shaft; and distributing a portion of the torsional load to each torque transfer feature using one or more elastic mounts positioned within each pocket and interposing the shank and an inner wall of each pocket.

14. The method of claim 13, wherein rotating the outer housing of the steering assembly comprises one of rotating the outer housing by rotating a drill string coupled to the outer housing and rotating the outer housing by operating a downhole drilling motor coupled to the outer housing.

15. The method of claim 13, wherein the downhole steering assembly further includes a joint housing secured within the outer housing and defining a plurality of housing slots, and each torque transfer feature further includes a head received within a corresponding one of the plurality of housing slots, and wherein transferring the torsional load to the drive shaft further comprises transferring a tangential load of the torsional load to each torque transfer feature as the head engages the corresponding one of the plurality of housing slots.

16. The method of claim 13, allowing rotation of the plurality of torque transfer features within each pocket with the one or more elastic mounts.

17. The method of claim 13, wherein the one or more elastic mounts comprise a compliant material and distributing the portion of the torsional load to each torque transfer feature comprises flexing the compliant material and thereby allowing each shank to shift within the corresponding one the plurality of pockets and assume the portion of the torsional load.

18. The method of claim 13, further comprising preventing compression of the one or more elastic mounts beyond an elastic limit with one or more hard stops positioned within the plurality of pockets.

19. The method of claim 13, wherein the one or more elastic mounts are selected from the group consisting of an annular ring, a canted coil spring, a spring bushing having arcuate extensions extending in opposing angular directions, and a biasing device positioned within a cross-bore defined in the drive shaft and opening into the pocket.

20. The method of claim 13, further comprising rotating a drill bit operatively coupled to the drive shaft.

* * * * *